US011896881B2

(12) United States Patent
Klatt

(10) Patent No.: US 11,896,881 B2
(45) Date of Patent: Feb. 13, 2024

(54) WEIGHTED BATTING SLEEVE

(71) Applicant: Ryan Klatt, Midland, TX (US)

(72) Inventor: Ryan Klatt, Midland, TX (US)

( * ) Notice: Subject to any disclaimer, the term of this patent is extended or adjusted under 35 U.S.C. 154(b) by 0 days.

(21) Appl. No.: 17/579,123

(22) Filed: Jan. 19, 2022

(65) Prior Publication Data

US 2023/0226420 A1 Jul. 20, 2023

(51) Int. Cl.
*A63B 69/36* (2006.01)
*A63B 60/02* (2015.01)
*A63B 69/00* (2006.01)

(52) U.S. Cl.
CPC ..... *A63B 60/02* (2015.10); *A63B 69/0002* (2013.01); *A63B 2069/0008* (2013.01)

(58) Field of Classification Search
CPC ..... A63B 60/02; A63B 69/0002; A63B 2069/0008
USPC ..... 473/437, 457
See application file for complete search history.

(56) References Cited

U.S. PATENT DOCUMENTS 5,199,706 A * 4/1993 Chen ..... A63B 60/14 473/549
5,592,953 A * 1/1997 Delao ..... A61F 15/004 128/882
5,695,419 A * 12/1997 Haringa ..... A63B 69/0002 473/564
6,533,685 B1 * 3/2003 Otten ..... A63B 59/60 473/437
8,231,484 B1 * 7/2012 Quinn ..... A63B 15/00 473/422
10,441,861 B1 * 10/2019 Mattern ..... A63B 60/46
2003/0004020 A1 * 1/2003 Ogawa ..... A63B 59/52 473/564
2003/0224883 A1 * 12/2003 Liberatore ..... A63B 59/50 473/457
2004/0063519 A1 * 4/2004 Liberatore ..... A63B 21/06 473/457
2004/0209711 A1 * 10/2004 Liberatore ..... A63B 15/00 473/457
2007/0219027 A1 * 9/2007 Chong ..... A63B 59/50 473/457
2010/0137078 A1 * 6/2010 Liberatore ..... A63B 21/0608 473/437
2016/0051877 A1 * 2/2016 Sieber ..... A63B 69/0002 473/457

* cited by examiner

*Primary Examiner* — Nini F Legesse
(74) *Attorney, Agent, or Firm* — Jeffrey L. Streets

(57) ABSTRACT

A weighted batting sleeve or apparatus includes an elastic ring manually stretchable to be received about a barrel portion of a bat and to impart an elastic force against the barrel portion. The apparatus further includes a tubular fabric sleeve extending over an outer surface of the elastic ring and a fabric casing coupled to the tubular fabric sleeve and enclosing the elastic ring. The apparatus may be passed over a knob of the bat and slid up the bat to a position with the elastic ring near the end of the bat. The tubular fabric sleeve may extend over a hitting area of the bat but does not obstruct the hitting area. Accordingly, the apparatus is useful for practice swings and for hitting drills, where positioning the elastic ring near the end of the bat puts the weight in position to promote proper hitting mechanics.

21 Claims, 10 Drawing Sheets

WEIGHTED BATTING SLEEVE

BACKGROUND

The present disclosure relates to a weight that is securable to a baseball bat or softball bat.

BACKGROUND OF THE RELATED ART

Baseball and softball are popular team sports that are played throughout many countries of the world. The various positions on a baseball or softball team each require specialized skills and talents. However, batting is a skill that is needed by every player of the team. When a particular player is batting ("at bat"), that player stands in a batter's box while a pitcher from the other team throws ("pitches") the ball across a plate next to the batter's box. To hit the ball, the player must swing their bat quickly, accurately and with good technique as the ball passes across the plate at a high rate of speed. Furthermore, the player's chances of hitting the ball out of the infield are increased if the player swings their bat with strength through their arms, torso, and legs so that the ball may be driven off the bat at a high rate of speed.

FIG. 1 is a diagram of a typical bat 10. The bat 10 is generally a solid of rotation about a central axis 15, such that a side view of the bat 10 is the same regardless of the degree of rotation about the central axis. However, the contour of the bat 10 that establishes an outer surface of the bat varies along the length "L" of the bat. Beginning at the left-hand side of FIG. 1, the bat 10 includes a knob 12, handle portion 14, taper portion 16, barrel portion 18 and end portion (also end cap) 20. The barrel 18 (also referred to as the "head" of the bat) is the part of the bat having the largest diameter and a major portion of the total weight of the bat. A player will grip the handle 14 with both hands and swing the bat 10 with the intention of making contact with a pitched ball in a hitting area 17 of the bat.

A player that is soon to have their turn at bat may spend a few minutes taking practice swings with their bat to warm up their muscles and get focused on their batting technique or mechanics. Some players may even temporarily attach a weight to their bat during this warmup to activate their muscles more thoroughly. One such batting weight is a heavy ring or "doughnut" (alternatively "donut") that is positioned near the handle or taper of the bat.

FIG. 2 is a diagram of the bat 10 having a doughnut-style batting weight 11 positioned about the taper 16 of the bat. The doughnut-style batting weight 11 forms a ring of solid material about a central opening 13. The central opening 13 must have a diameter that is large enough to allow the batting weight 11 to pass over the knob 12 of the bat (as shown at the left-hand side of FIG. 2), yet the diameter must also be small enough that the batting weight 11 is firmly seated on the taper 16 of the bat so that the batting weight 11 does not slip over the barrel 18 and off the end portion 20 of the bat.

Doughnut-style batting weights are available in a variety of weights, such as 8, 10, 16, and 20 ounces. At these weights, a player swinging their bat with a doughnut may experience an amount of resistance that is enough to compromise their batting technique, especially in kids up to high school age. These weights also limit the amount of time a player can swing their bat before their muscles become fatigued and their mechanics breakdown.

An alternative to the doughnut is a weight that sits on the barrel of the bat to deliver a similar amount of weight to the bat. The drawback to this barrel style of weight is that the bat cannot be used for any hitting drill with the weight attached. Attempts to use a barrel weight on a bat during a hitting drill will lead to a baseball contacting the barrel weight, damaging the barrel weight, reducing or eliminating feedback to the player through the handle of the bat as a result of contact between the baseball and the bat, and preventing nearly all hitting drills. Although a barrel weight may be suitable for use by a player warming up in an on-deck circle, the barrel weight is wholly unworkable for a hitting drill because it obstructs the hitting area of the bat.

BRIEF SUMMARY

Some embodiments provide an apparatus comprising an elastic ring manually stretchable to be received about a barrel portion of a bat and to impart an elastic force against the barrel portion of the bat, a tubular fabric sleeve extending over an outer circumferential surface of the elastic ring, and a fabric casing coupled to the tubular fabric sleeve and enclosing the elastic ring.

Some embodiments provide an apparatus comprising a first elastic ring that is manually stretchable to be received about a barrel portion of a bat and to impart an elastic force against the barrel portion of the bat, and a second elastic ring that is manually stretchable to be received about a taper portion of the bat and to impart an elastic force against the taper portion of the bat. The apparatus further comprises a tubular fabric sleeve having a first sleeve portion extending over the first elastic ring, a second sleeve portion covering a hitting surface of the bat, and a third sleeve portion extending over the second elastic ring. Still further, the apparatus comprises a first fabric casing enclosing the first elastic ring and secured to the first sleeve portion and a second fabric casing enclosing the second elastic ring and secured to the third sleeve portion, wherein the second elastic ring is positionable in the taper portion of the bat with the first elastic ring positioned adjacent the distal end of the bat.

DETAILED DESCRIPTION

Figure 1:
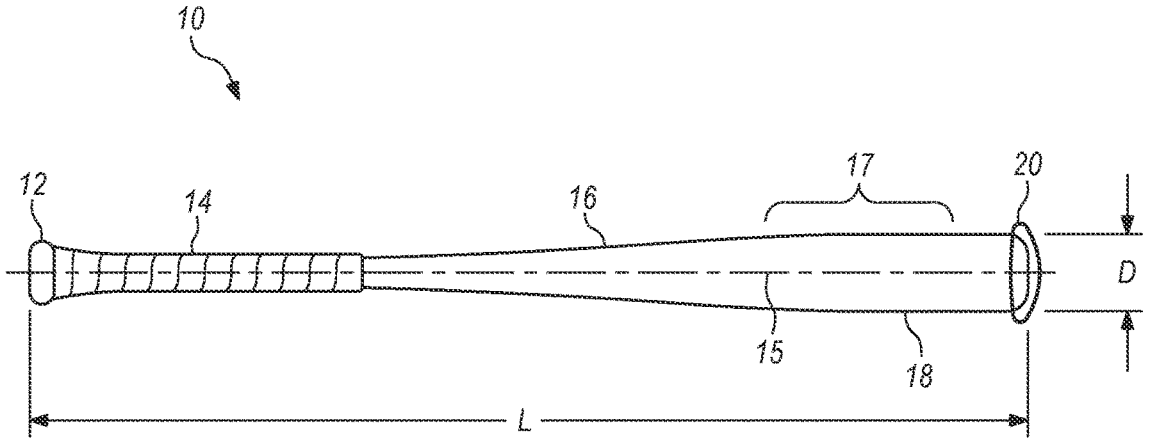
FIG. 1 (Prior Art)
FIG. 1 is a side view of a prior art bat as may be used in baseball or softball.
Figure 2:
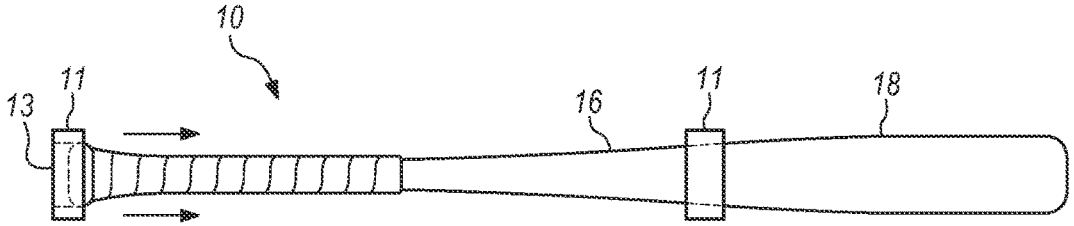
FIG. 2 (Prior Art)
FIG. 2 is a side view of the bat with a doughnut-style batting weight passing over the knob and seated against the taper of the bat.

Some embodiments provide an apparatus comprising an elastic ring manually stretchable to be received about a barrel portion of a bat and to impart an elastic force against the barrel portion of the bat, a tubular fabric sleeve extending over an outer circumferential surface of the elastic ring, and a fabric casing coupled to the tubular fabric sleeve and enclosing the elastic ring. The apparatus may be referred to as a 'weighted batting sleeve" or similar term. The apparatus may be slid over a knob of a baseball or softball bat and slid up the bat into a position with the elastic ring near the end of the bat.

In some embodiments, the tubular fabric sleeve may extend a minimal distance in either axial direction of the elastic ring, such that the tubular fabric sleeve primarily covers the elastic ring. For example, the tubular fabric sleeve may extend between about 0.5 inches and about 1.5 inches in either axial direction of the elastic ring. Accordingly, the tubular fabric sleeve may protect the elastic ring that is positionable adjacent a distal end of the bat without extending into a hitting area of the bat. In one option, the tubular fabric sleeve that extends over the elastic ring may have an axial length from about 2 inches to about 3 inches. Other than the axial length, embodiments with a (short) tubular fabric sleeve may be constructed in the same manner as described below for longer tubular fabric sleeves In some embodiments, the tubular fabric sleeve includes a first sleeve portion extending over the outer circumferential surface of the elastic ring and a second sleeve portion extending from the first sleeve portion for covering a hitting area of the bat. The first and second sleeve portions are preferably formed from a single piece of fabric that is sized and shaped to form both the first and second sleeve portions. The second sleeve portion may have an axial length to extend over a hitting area of the bat and into a taper portion of the bat with the first sleeve portion positioned within an inch of a distal end of the bat, wherein the second sleeve portion has a diameter that causes the second sleeve portion to be stretched around a circumference of the bat and to impart an elastic force against the bat. The second sleeve portion forms a durable and responsive hitting surface while serving to secure the elastic ring to the bat. The fabric used to form the tubular fabric sleeve is stretchable and elastic to apply an elastic force against the surface of the bat. Accordingly, a total amount of static friction between the second sleeve portion and the bat is generally proportional to the total contact area between the second sleeve portion and the surface of the bat.

In some embodiments, the second sleeve portion may have a circumference that tapers toward a proximal end of the second sleeve portion. For example, the second sleeve portion may taper in proportion to an amount of taper (i.e., a gradual reduction in diameter) of a taper portion of a particular bat or the second sleeve portion may taper in a manner that will universally fit the barrel and taper portions of all bats within a particular barrel classification or standard for bat dimensions. The fabric used to form the second sleeve portion may be stretchable to fit a range of bat dimensions, including a range of lengths, a range of diameters, and/or a range of tapers. Although not a requirement, the second sleeve portion preferably has circumferential dimensions that enable the second sleeve portion to be stretched over a surface of the bat and fit snug against the surface of the bat.

Embodiments of the apparatus may be configured for use with any current or future barrel classification. There are currently three main barrel classifications, where each barrel classification specifies a maximum barrel diameter of 2.25 inches, 2.625 inches, and 2.75 inches. For example, softball uses a consistent 2.25-inch maximum diameter for all players from youth play to Olympic competition. Baseball uses all three main barrel classifications for metal bat competition, including a 2.625-inch maximum diameter for high school and National Collegiate Athletic Association (NCAA) competition, and a 2.75-inch maximum diameter for various age groups and organizations for players between the ages of 5 and 14. Most wooden baseball bat models have a diameter between 2.40 inches and 2.61 inches. The maximum diameter for a bat used in Major League Baseball (MLB) play is 2.61 inches. However, embodiments may be made with various diameters, lengths and weights of the elastic rings for use with a bat having any known diameter.

In some embodiments, the tubular fabric sleeve is made with a plated fabric having a plated side that forms an outer surface of the tubular fabric sleeve and an unplated side that forms an inner surface of the tubular fabric sleeve. The plated side of the fabric is both durable against wear that may occur due to hitting baseballs or softballs and the plates reduce the extent to which the fabric stretches. For example, the plated fabric may optionally include a fabric layer that is polyester, nylon and/or spandex, such as a blend of nylon and spandex. The plated fabric may further have discrete plates formed on the fabric layer. For example, the discrete plates may be formed with ceramic or a polymer, such as an epoxy. Furthermore, the discrete plates may be arranged in a repeating pattern, such as a hexagonal pattern, on the outer surface of the fabric layer. The fabric layer has elasticity and is stretchable, but embodiments use the discrete plates to limit an amount of stretch in the fabric for the purpose of hitting a baseball or softball with a fabric-covered hitting area of a bat. A high degree of elasticity may significantly reduce an amount of friction between the bat and the ball since the fabric may stretch and/or slide rather than cause friction. The discrete plates are formed into the fibers on one side of the fabric and are rigid. The arrangement or pattern of the discrete plates and the size of the individual plates on the fabric may determine the effect on the stretchability of the fabric in one or more dimensions since the fabric directly under the plates has very limited stretchability and substantially all of the stretchability of the fabric comes from the areas of fabric between the plates. A repeating hexagonal pattern is believed to limit stretchability substantially evenly in all directions within a plane of the fabric. The tubular fabric sleeve is preferably thin to maintain natural feedback from a batted ball. For example, the tubular fabric sleeve may have a thickness of about 0.5 millimeters to about 1.5 millimeters, or more particularly a thickness of about 0.8 millimeters to about 1.1 millimeters. It is believed that the plated fabric will easily withstand over 100,000 hits.

Some embodiments of a plated fabric may be obtained from Higher Dimension Materials of St. Paul, Minnesota, that sells SuperFabric® brand materials. SuperFabric® materials come in a variety of plate patterns or arrangements. By changing the plate pattern, including the size of gap between plates and the shape of the individual plates, certain performance criteria can be enhanced or decreased such as cut or abrasion resistance and stretchability (effective elasticity) in addition to a unique look and design. The guard plates may, for example, be made of ceramic or a polymer, such as an epoxy. One particularly preferred plated fabric is SuperFabric® 600120-900, made of a nylon/spandex blend, and having a plate pattern identified as 80/40-300. The plate pattern may include plates that are equidistant from each other and allow for equal stretching around the barrel of a bat (a circumferential direction) as well as lengthwise down the barrel of the bat (an axial direction). The stretchability of the plated fabric allows a single size of tubular fabric sleeve to fit bats having different lengths and tapers. A hexagonal plate pattern may be formed with rows of evenly spaced plates, wherein adjacent rows are staggered by half of the spacing between plates in a row.

In some embodiments, the tubular sleeve may be cut using a pattern and sewn to have a resting diameter that is about the same as the barrel diameter of the bat or perhaps only slightly less than the barrel diameter. In one option, the tubular sleeve may have a resting circumference measurement that is between about 0 inch to about ½ inch less, most preferably about ⅛ inch less, than the circumference of the barrel portion of the bat. In a specific example, if the intended bat has a barrel diameter of 2.75 inches (a 220 mm circumference), the elastic ring may have a resting length of 180 mm such that the elastic ring must stretch 40 mm (about 22%) to be positioned around the barrel of the bat. For the same bat, the preferred plated fabric (SuperFabric® 600120-900, made of a nylon/spandex blend, and having a plate pattern identified as 80/40-300) may have a resting diameter just under the barrel diameter, such as ⅛ inch (about 3 mm) less than the 220 mm circumference of the barrel, so that the tubular fabric sleeve may lightly squeeze the hitting area of the bat, keeping the sleeve taut and not baggy. However, the tubular fabric sleeve will be significantly stretched where it extends over the elastic ring(s) and will apply an elastic force over the elastic ring(s) and against the barrel portion of the bat, in addition to the elastic force (squeeze) applied by the elastic bands themselves. An unplated fabric would need to be significantly smaller in circumference relative to the bat barrel circumference in order to fit snug on the bat and/or to apply a similar elastic force about the elastic ring(s).

In some embodiments, the fabric casing is formed with a second flexible fabric that is not a plated fabric. Optionally, the fabric casing may use a fabric made of polyester, nylon, and/or spandex, such as a blend of nylon and spandex. Spandex is believed to be a polyether-polyurea copolymer. The fabric used to make the fabric casing is preferably thin enough, such as a thickness of about 0.8 millimeters to about 1.3 millimeters, and most preferably about 1 millimeter, to precisely conform to the shape of the elastic ring and to stretch with the elastic ring as it expands over the barrel of a bat. The fabric of the fabric casing should also be durable to withstand the repeated actions of putting the device on a bat and taking it off of a bat. The casing fabric may also be thin and lightweight so that the elastic ring is the primary source of weight for the apparatus. Accordingly, the weight of the apparatus can be focused near the end of the bat where the elastic ring is positioned without having any significant amount of weight distributed along the length of the apparatus. The tubular fabric sleeve and the casing fabric are both very lightweight such that the elastic ring is the primary source of weight provided by the weighted batting sleeve.

In some embodiments, the elastic ring may be the primary source of weight for the apparatus. The fabric sleeve and casing portions are relatively lightweight in comparison to the elastic ring. The elastic ring is stretched over the barrel of the bat to apply an elastic force that is the primary manner for keeping the elastic ring in a desired position on the bat. The elastic ring preferably has an elasticity that enables the fabric encased elastic ring to be easily slid along the taper and barrel portions of the bat yet applies a sufficient elastic force against the surface of the bat to keep the elastic ring from moving because of a practice swing or hitting drill.

The elastic ring may be made with any material that has sufficient elasticity to be stretched and released to impart an elastic force against a relevant portion of the bat. The elastic force in combination with an amount of contact area will preferably form enough static friction between the fabric casing and the surface of the bat to keep the elastic ring on the bat as the batter swings the bat at a high rate of speed. In one example, the elastic ring may be made with silicone rubber, which is also known as polysiloxane. The silicone rubber may be the same material used to make inexpensive novelty bracelets or wristbands or it may be a food grade silicone rubber. The silicone rubber bands may be formed by injection molding. Optionally, the silicone rubber may be used alone or may contain additives that modify one or more physical property of the silicone rubber. Since silicone rubber weathers well and has a suitable density, additives are generally unnecessary. Furthermore, the casing fabric protects the surface of the silicone rubber from abrasion and the tubular fabric sleeve protects the casing fabric from being torn or worn.

The elastic ring may have overall dimensions, such as a length (i.e., along an inner circumference), thickness and width, that establish the weight of the elastic ring for any given elastic material. The thickness of the band is the distance from the inner surface to the outer surface, and the width of the band is the distance from one side edge to the other side edge. A preferred elastic ring may have a width between 0.5 and 2 inches, a thickness of height no greater than 0.5 inches, and a resulting weight that is between 1 and 4 ounces. In one option, the elastic ring weighs about 2 and about 3 ounces.

The one or more elastic ring(s), the elastic bands forming one or more elastic ring(s), the tubular fabric sleeve and the casing fabric each preferably have elasticity or stretchability to allow them to fit snug or even tight over the relevant parts of a bat. In fact, it is this elasticity or stretchability that imparts elastic forces against the surface of the bat to keep the weighted batting sleeve in place on the bat during practice swings and/or hitting drills. Accordingly, the stretched dimensions of each component of the weighted batting sleeve will change when stretched to be installed on a bat in accordance with the exact dimensions of the bat, such as the diameter of the barrel portion, the diameter of the taper portion, and the length of the taper portion. It should be recognized that, unless clearly stated otherwise herein, the dimensions described for embodiments of the one or more elastic ring(s), the elastic bands forming one or more elastic ring(s), the tubular fabric sleeve and the casing fabric are "resting" dimensions, meaning the dimensions in a relaxed or unstretched (no tension) condition.

The elastic ring may be positioned within about one inch from the end of the bat. Most preferably the elastic ring and/or the distal end of the sleeve may be positioned within about 0.5 inches from the distal end of the bat. Independently, the elastic ring has a total thickness that is preferably no more than about 0.5 inches. For example, if each band has a thickness of 2 millimeters, then a weighted ring could have up to six bands having a total thickness of 12 millimeters (about 0.47 inches) without exceeding the preferred limit of 0.5 inches.

In some embodiments, the elastic ring may include a plurality of concentrically nested elastic bands. For example, the plurality of concentrically nested elastic band may include from 2 to 6 elastic bands. Optionally, each of the plurality of concentrically nested elastic bands may be made with silicone rubber. Although a single thick elastic band may be used, it has been found that multiple thinner elastic bands may require less force and effort to stretch (lengthen) to fit over the barrel of the bat than for a single thick elastic band. Furthermore, making the elastic ring from a plurality of concentrically nested elastic bands facilitates preparation of weighted batting sleeves with stepwise differences in weight simply by changing the number of elastic bands that are used to form the elastic ring. It should be recognized that the definitions of length, thickness and width set out herein in reference to an elastic ring may also be used to describe the dimensions of individual elastic bands and/or the elastic ring in embodiments that form the elastic ring with a plurality of concentric nested elastic bands.

In a further option, each of the concentrically nested elastic bands may have a length that is different from the length of the each other concentrically nested elastic bands, wherein the length of the each concentrically nested elastic band increases from an inner-most one of the concentrically nested elastic bands to an outer-most one of the concentrically nested elastic bands, and wherein each of the concentrically nested elastic bands contacts each immediately adjacent one of the concentrically nested elastic bands. Optionally, each of the elastic bands may have a thickness between about 2 millimeters and about 4 millimeters, such as about 2 millimeters. The length of an elastic band is, as described herein, measured along the inner circumference of the elastic band.

In some embodiments, the plurality of concentrically nested elastic bands may have at least one pair of directly adjacent elastic bands including a first elastic band with an outer diameter and a second elastic band with an inner diameter, wherein the second elastic band has an inner diameter that is less than the outer diameter of the first elastic band and imparts an elastic force on the first elastic band. For example, a first (inner) elastic band having a length of 180 mm and a thickness of 2 mm would have an outer surface that would be flush with an inner surface of a second (outward adjacent) elastic band having a length of 192 mm. However, if the second elastic band instead has a length of 190 mm, then the second elastic band will be stretched over the first elastic band and apply an elastic (inwardly directed) force on the first elastic band.

The elastic bands have a preferred width of between about 20 mm and about 30 mm. A silicone ring made with silicone bands having a width of about 25 mm and a height of no more than 0.5 inches will have a weight between about 1.25 ounces and about 4 ounces. Optionally, the silicone ring or the silicone bands may have a width of 30 mm, 35 mm or 37 mm (1.5") wide if it is desired to make a weighted batting sleeve having additional weight. With the bands being 2 mm thick, each outward adjacent band needs to be a about 12.5 mm longer on the inner circumference than the immediately inward adjacent band in order for the surfaces of the two bands to be perfectly flush.

In some embodiments having an elastic ring formed with a plurality of concentric bands, the inner concentric bands may have a length relative to the diameter or circumference of the bat that will cause them to apply a greater elastic force against the surface of the bat than the outer concentric bands. An outer-most one of the concentric bands may also have a length relative to the inner concentric bands that will apply an elastic force on the inner concentric bands to help keep the concentric bands together in the shape of a single ring.

In one specific and non-limiting embodiment, the first two (inner-most) bands for a 2.75-inch diameter bat have lengths (i.e., 180 mm and 190 mm lengths, respectively) that are a couple of millimeters of length short of being flush when the shorter band is placed inside the longer band. Accordingly, there is a tight fit between the two bands. The next two (intermediate) bands (i.e., 202 mm and 215 mm lengths, respectively) may be flush with each other and fit exactly without stretching. The last (outer-most) band (i.e., 225 mm length) is a little shorter and tighter against the intermediate bands and hold the whole assembly of five concentric bands together in a stacked alignment.

Some embodiments of the elastic ring that include a plurality of concentric bands may further include an adhesive between any two adjacent bands. Using an adhesive may help keep the bands aligned or nested one band over the other band. One example of such an adhesive is available in spray form as E6000 from Eclectic Products Inc. of Eugene, Oregon.

Some embodiments of the plurality of concentric bands may include embossed features and debossed features that interlock with the embossed features. For example, a pair of adjacent bands may have an interlocking relationship that prevents the bands from becoming misaligned while allowing each band to stretch. In one option, a first band may have an outer surface with an embossed feature or protrusion and a second band may have an inner surface with a debossed feature or indentation that interlocks with the embossed feature or protrusion of the first band. Each band may have any number, size or arrangement of the embossed and/or debossed features for the purpose of interlocking the band with an adjacent concentric band. One non-limiting example may have three outwardly directed circular embossed (raised) features at about 120 degrees about the axis of a first band and three similar inwardly directed circular debossed (recessed or sunken) features at about 120 degrees about the axis of a second band that is directly adjacent and outward of the first band. Alternatively, the embossed feature could be a raised circumferential ridge on a first band and the debossed feature could be a recessed circumferential groove on a second that receives the circumferential ridge. The height of an embossed feature and the depth of a debossed features is preferably less than 1 millimeter.

Some embodiments provide an apparatus comprising a first elastic ring that is manually stretchable to be received about a barrel portion of a bat and to impart an elastic force against the barrel portion of the bat, and a second elastic ring that is manually stretchable to be received about a taper portion of the bat and to impart an elastic force against the taper portion of the bat. The apparatus further comprises a tubular fabric sleeve having a first sleeve portion extending over the first elastic ring, a second sleeve portion covering a hitting surface of the bat, and a third sleeve portion extending over the second elastic ring. Still further, the apparatus may comprise a first fabric casing enclosing the first elastic ring and secured to the first sleeve portion and a second fabric casing enclosing the second elastic ring and secured to the third sleeve portion, wherein the second elastic ring is positionable in the taper portion of the bat with the first elastic ring positioned adjacent the distal end of the bat. Accordingly, two separate elastic rings may be secured to a bat by a single sleeve. The elastic ring or bands near the handle or taper of the bat have a much smaller circumference, such as 120-140 millimeters, than the circumference of the elastic ring or bands positionable over the barrel of the bat, such as 180-225 millimeters. These embodiments enable a greater amount of weight to be added to the bat without either elastic ring or other obstruction being positioned in the hitting area of the bat. Optionally, the tubular fabric sleeve may include a second sleeve portion having a circumference that tapers toward the third sleeve portion.

It should be recognized that embodiments having first and second elastic rings and a tubular fabric sleeve having first, second and third sleeve portions may be constructed using the same techniques, materials, and concepts described for any of the embodiments described as having a single elastic ring. Specifically, each elastic ring may be made in the same manner, enclosed in encasing fabric in the same manner, and secured to the tubular fabric sleeve in the same manner, albeit at opposite ends of the tubular sleeve and with dimensions suited to the diameter of the relevant portions of the bat.

Embodiments of the weighted batting sleeve are preferably easy for players of all ages to secure and remove from a bat. The weighted batting sleeve is received over the knob of the bat and slid along the length of the bat until the elastic ring is positioned adjacent the end of the bat. There are no fasteners, such as Velcro straps, or retainer bands of metal, or any other material, necessary to secure the weighted batting sleeve to a bat. Furthermore, the weighted batting sleeve is slid onto the bat along the taper portion of the bat, which means that the player does not have to stretch the device to fit directly over the distal end portion of the bat.

Embodiments of the weighted batting sleeve position the elastic ring or rings outside of the hitting area of the bat. In fact, the embodiments have no obstructions in the hitting area of the bat, which allows the weighted batting sleeve to be used in various (all) hitting drills. Only the sleeve may be positioned over the hitting area of the bat, but the sleeve fabric is durable and does not interfere with hitting or tactile feedback to the hands of the batter. Furthermore, positioning the weight near the distal end of the bat for hitting drills fosters proper hitting mechanics, such as hand and bat path, and strengthens the most important portion of the swing for maximum bat speed and power. For example, positioning the weight near the end of the bat forces the batter's hands inside the baseball, a term used to describe the most efficient and powerful way to deliver force to a baseball from a bat. Keeping one's "hands inside the ball" allows the bat to stay in the hitting area for a longer time, increasing the likelihood of contact. This contact also has an increased likelihood of greater bat speed and power being delivered to the pitched baseball. In the event that the weights come into contact with a thrown ball, the fact that the weights are elastic rings, such as silicon rings or bands, means that there will be little or no damage to the ball or to the weighted batting sleeve. An optional adhesive between adjacent elastic bands helps to keep the individual elastic bands from moving or spreading out.

Figure 3A:
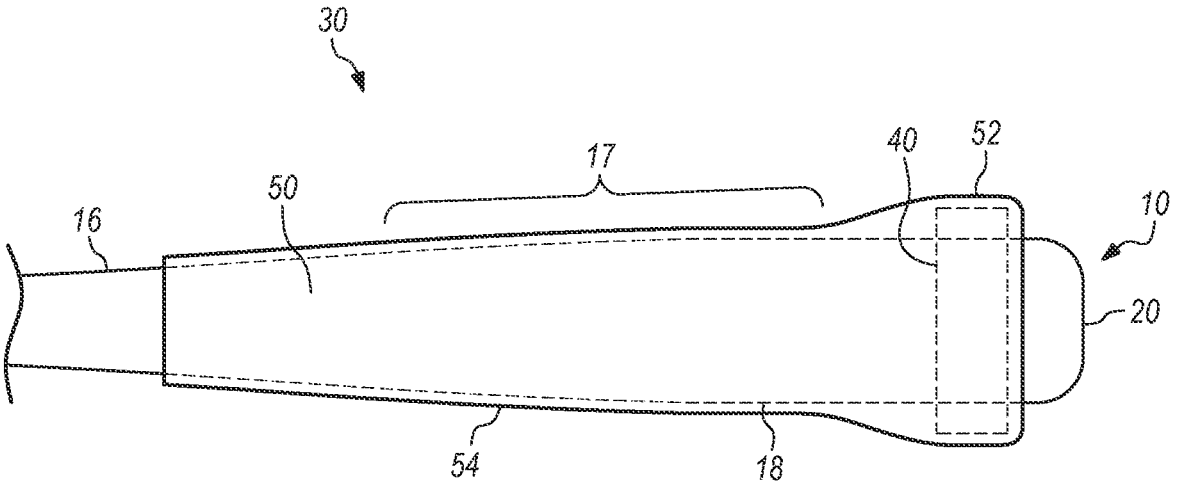
FIGS. 3A-B provide a side view and a cross-sectional side view of a first embodiment of a weighted batting sleeve received on the bat.
Figure 3B:
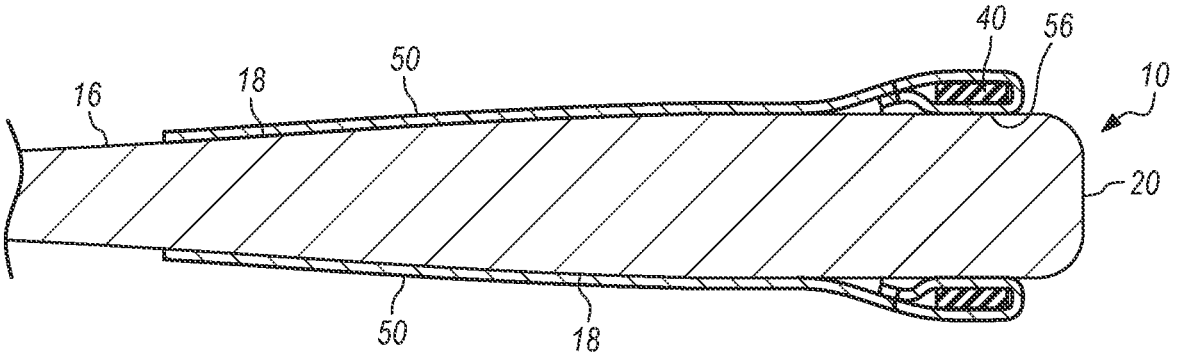

FIG. 3A provides a side view and FIG. 3B provides a cross-sectional side view of a first embodiment of a weighted batting sleeve 30 received on the bat 10. The weighted batting sleeve includes an elastic ring 40 manually stretchable to be received about a barrel portion 18 of the bat 10 and to impart an elastic force against the barrel portion of the bat. A tubular fabric sleeve extends over an outer circumferential surface of the elastic ring 40, and a fabric casing 56 is coupled to the tubular fabric sleeve 50 and enclosing the elastic ring. The apparatus may be referred to as a 'weighted batting sleeve" or similar term. The apparatus may be slid over a knob (see knob 12 in FIG. 1) of a baseball or softball bat and slid up the bat into a position with the elastic ring 40 around the barrel 18 and near the end 20 of the bat 10. For purposes of the disclosed embodiments, the end 20 of the bat 10 may also be referred to as an "end cap" and should be considered to include that portion of the bat that is beyond the barrel 18.

The tubular fabric sleeve 50 includes a first sleeve portion 52 extending over the outer circumferential surface of the elastic ring 40 and a second sleeve portion 54 extending from the first sleeve portion 52 for covering a hitting area 17 of the bat 10. The first and second sleeve portions 52, 54 are preferably formed from a single piece of fabric that is sized and shaped to form both the first and second sleeve portions. The second sleeve portion 54 may have an axial length to extend over the hitting area 17 of the bat 10 and into a taper portion 16 of the bat 10 with the first sleeve portion 52 positioned within about an inch of the distal end 20 of the bat 10. The second sleeve portion 54 has a diameter that causes the second sleeve portion 54 to be stretched around a circumference of the bat 10 and to impart an elastic force against the surface of the bat Specifically, a total amount of static friction between the second sleeve portion 54 and the bat is generally proportional to the total contact area between the second sleeve portion 54 and the surface of the bat 10. The second sleeve portion 54 forms a durable and responsive hitting surface that spans the hitting area 17 while serving to provide an additional or redundant manner to secure the elastic ring 40 to the bat 10. The weighted batting sleeve 30 and/or the tubular fabric sleeve may be referred to as having a shape that is similar to a "truncated cone" or having a portion that is similar to a "truncated cone", although this language should not be considered to limit the scope of the embodiments.

FIGS. 4A-J are a series of plan views, side views and cross-sectional side views illustrating the fabrication of the weighted batting sleeve 90 (see FIG. 4J) according to some embodiments. It should be noted that all embodiments disclosed may be made in accordance with the illustrated fabrication process with variations in the various dimensions and materials. The fabrication process is shown for the purpose of providing an example and should not be construed to limit the scope of the embodiments.

Figure 4A:
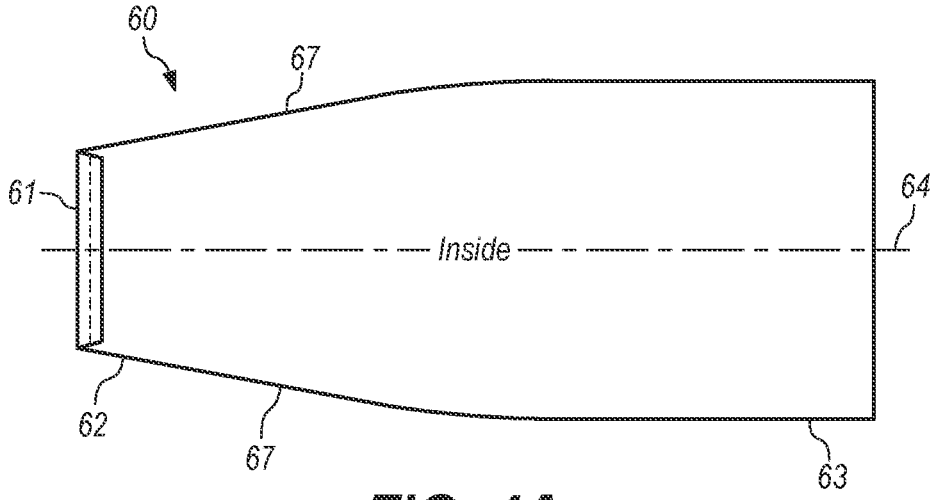
FIGS. 4A-J are a series of side views and cross-sectional side views illustrating the fabrication of a weighted batting sleeve according to some embodiments.

FIG. 4A is a plan view of a first piece of sleeve fabric 60 for making the outer layer of the tubular fabric sleeve (see tubular fabric sleeve 50 in FIGS. 3A-B). The first piece of sleeve fabric 60 is shown with its inside surface ("Inside") facing up for the purpose of forming a hem 61 at a proximal end 62 of the fabric 60. The narrow proximal end 62 will form the proximal end of the tubular fabric sleeve, whereas a wider distal end 63 will form the distal end of the tubular fabric sleeve. Two tapering edges 67 are also provided. Note the centerline 64 that defines an axial direction along the sleeve fabric 60. The proximal end 62 and the distal end 63 are at substantially opposite ends of sleeve fabric 60 along the axial direction 64. Note that the line illustrating the axial direction 64 also forms a fold line where the sleeve fabric 60 may be folded to form the tubular fabric sleeve.

Figure 4B:
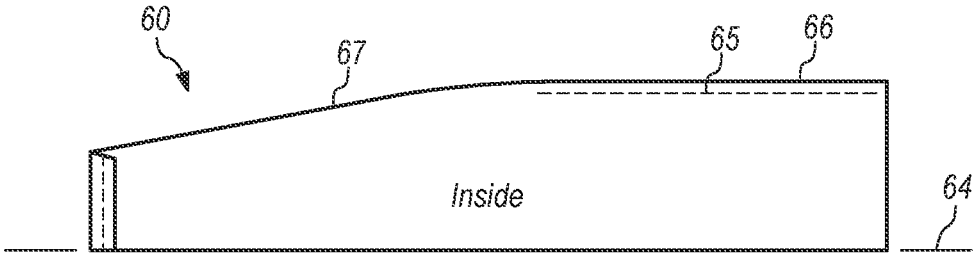

FIG. 4B is a diagram of the first piece of sleeve fabric 60 of FIG. 4A having been folded over along the fold line 64 and then sewn together along one edge of the fabric 60 to partially form the tubular sleeve. The thread stitches 65 are formed along an edge 66 that may be substantially parallel to the fold line 64. This section of the sleeve fabric 60 does not have a taper since it will be positioned over a barrel portion (see barrel portion 18 in of FIGS. 3A-B) of the bat.

Figure 4C:
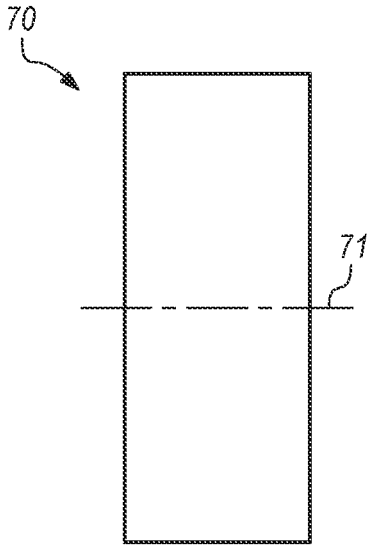

FIG. 4C is a plan view of a rectangular piece of a casing fabric 70 for making a casing that encloses the elastic ring 40 (shown in FIGS. 3A-B). The rectangular piece of a casing fabric is shown with a fold line 71 wherein the fabric is to be folded.

Figure 4D:
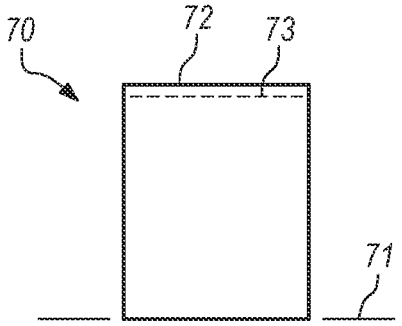

FIG. 4D is a diagram of the casing fabric 70 of FIG. 4C having been folded over along the fold line 71 and then sewn together along one edge 72 of the second fabric. The thread stitches 73 are formed along the edge 72 to form a tubular piece. In this embodiment, two pieces of the casing fabric 70 are used to make two tubular casing sleeves (only one shown). These two pieces of casing fabric 70 (identified with reference numbers 70A, 70B in FIG. 4E) are used in making one weighted batting sleeve.

Figure 4E:
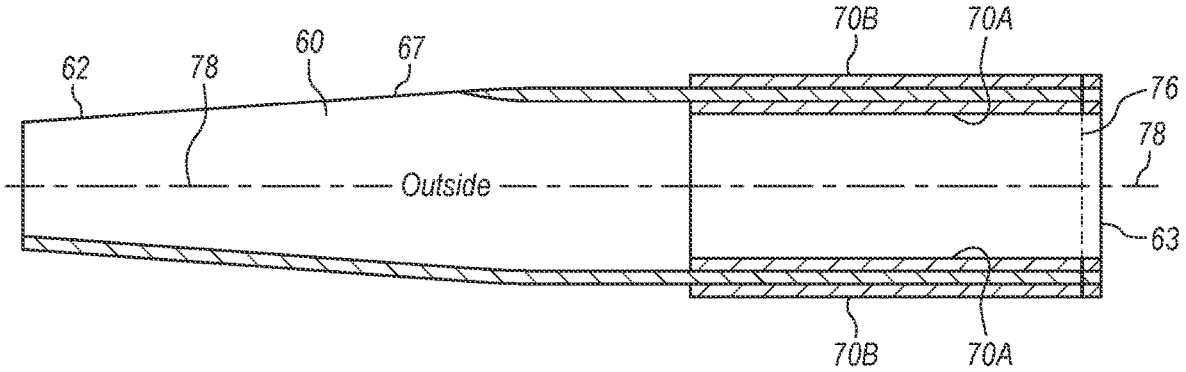

FIG. 4E is a cross-sectional side view of a first sewn piece of the casing fabric 70A concentrically positioned inside the tubular sleeve fabric 60 and a second sewn piece of the casing fabric 70B concentrically position outside the tubular sleeve fabric 60. With all three pieces of fabric 70A, 60, 80B arranged concentrically with the distal ends flush (to the right in FIG. 4E), the three layers of the fabrics 70A, 60, 80B are sewn together with threaded stitches 76, which are placed around the entire circumference of the fabrics 70A, 60, 70B. While the fabrics may lay flat, they are formed to be tubular (conforming to the surface of a tubular bat) and may be conveniently described as having an axial centerline 78. Note that the sleeve fabric 60 is still "inside-out" (or "outside-in"), yet the cross-sectional side view of FIG. 4E shows the "outside" surface of the sleeve fabric 60. For the purpose of these illustrations, the "outside" surface of the sleeve fabric 60 is intended to form the hitting surface, whereas the "inside" surface is intended to contact the surface of the bat 10. In some embodiments, it is the "outside" surface that is plated with discrete plates (not shown). It is also noted that the first and second sewn pieces of casing fabric 70A, 70B could be replaced with a single piece of casing fabric that is folded over the end (the right-hand end in FIG. 4E) of the tubular sleeve fabric 60 prior to being sewn by the threaded stitches 76. These and other minor modifications in the construction and/or assembly procedure are possible and are considered to be within the scope of the disclosed embodiments.

Figure 4F:
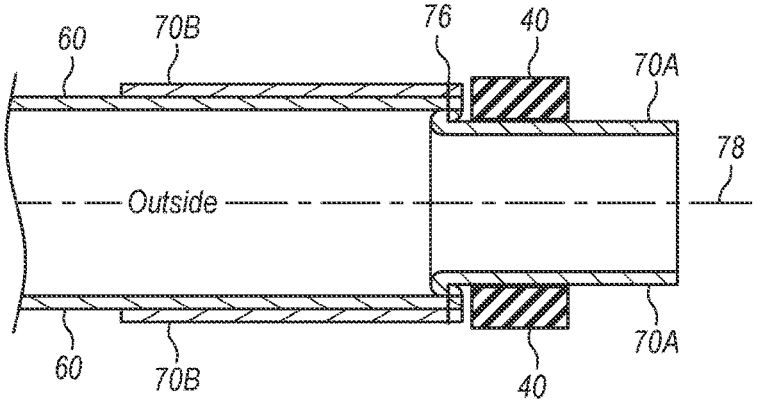

FIG. 4F is a cross-sectional side view of the assembly formed in FIG. 4E with the first piece of the casing fabric 70A extended outward (in the right-hand or distal direction in FIG. 4F) and an elastic ring 40 positioned on the outside of the first piece of the casing fabric 70A. The optional construction of the elastic ring 40 is discussed in reference to FIGS. 7A-D.

Figure 4G:
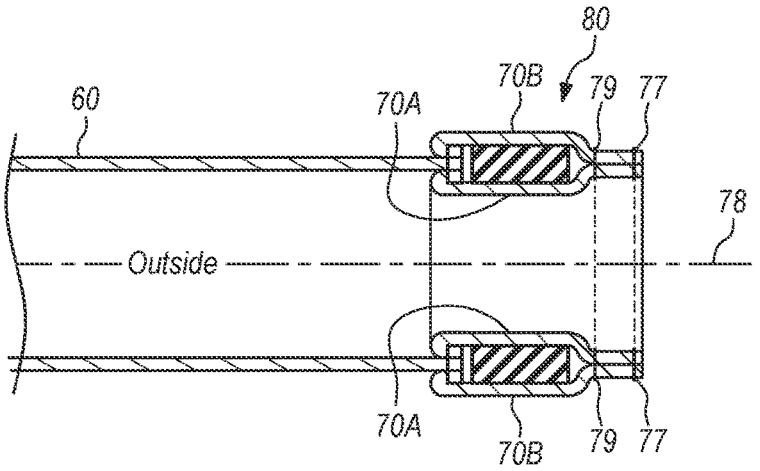

FIG. 4G is a cross-sectional side view of the assembly of FIG. 4F with the second piece of the casing fabric 70B extended outward (in the right-hand or distal direction in FIG. 4G) over the elastic ring 40. The second piece of the casing fabric 70B is then sewn to the first piece of the casing fabric 70A to form a casing 80 that encloses the elastic ring 40. The first and second pieces of casing fabric 70A, 70B are preferably pulled snug or tight against the elastic ring 40 and the stitches 79 are preferably formed as close as possible to the elastic ring 40. The stitches 79 are placed around the entire circumference of the fabrics 70A, 70B. In embodiments of the elastic ring 40 that are formed with a plurality of concentric bands, a snug or tight casing 80 may help to keep the concentric bands in a concentric stacked or aligned configuration during use. Optionally, the ends of the first and second pieces of casing fabric 70A, may also be stitched around their circumference with stitches 77 or cut off.

Figure 4H:
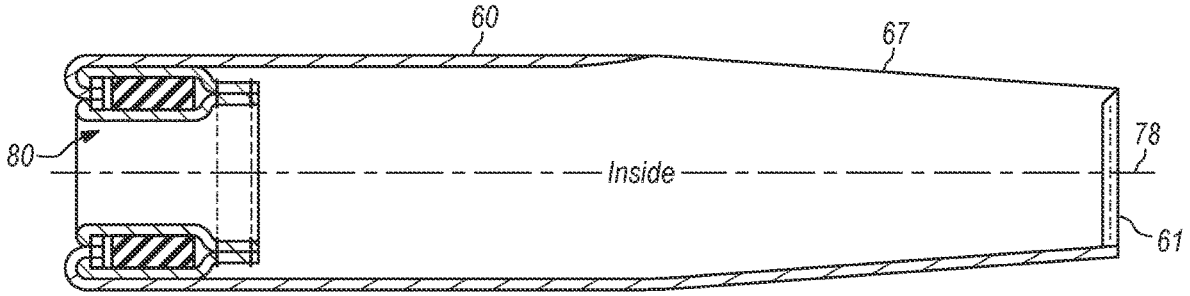

FIG. 4H is a cross-sectional side view of the assembly of FIG. 4G with the sleeve fabric folded around the outside of the casing 80 with the elastic ring 40 enclosed. Accordingly, the casing 80 is now inside the tubular sleeve fabric 60. Notice that this folding operation is facilitated by having not previously sewn the tapering edges 67 of the sleeve fabric 60 together. The tapering edges 67 are subsequently sewn together in reference to FIG. 4I.

Figure 4I:
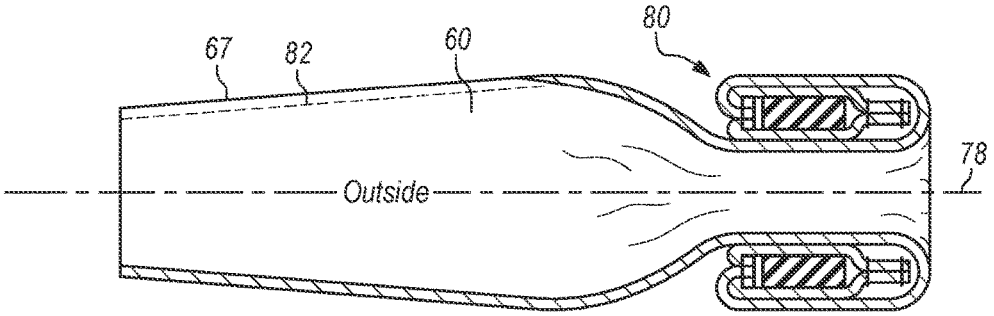

FIG. 4I is a cross-sectional side view of the assembly of FIG. 4H with the sleeve fabric further folded or tucked through the casing 80 so that the inside of the sleeve fabric 60 is directed outwardly (i.e., the "outside" is shown in the cross-sectional side view). In this configuration, the tapering edges 67 of the sleeve fabric 60 are sewn together with stitches 82 along the tapering edges 67.

Figure 4J:
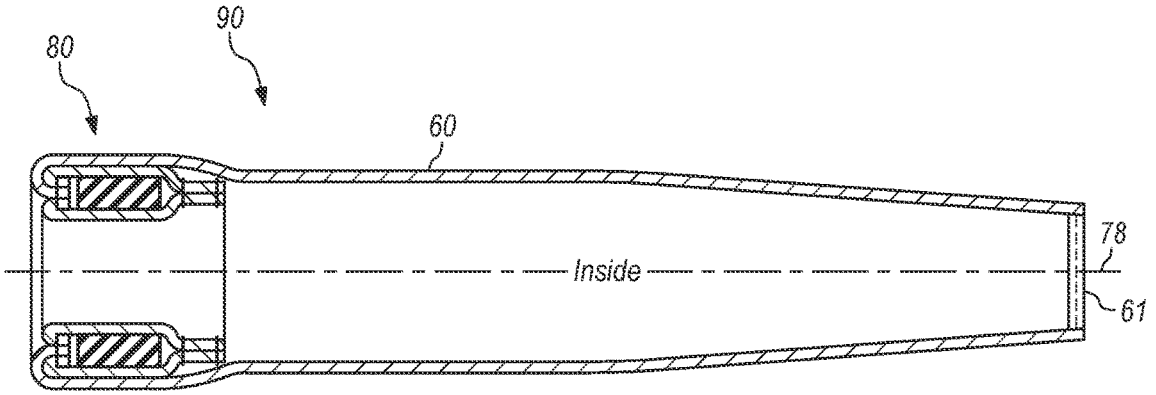

FIG. 4J is a cross-sectional side view of the assembly of FIG. 4I with the sleeve fabric 60 untucked from the casing 80 so that the weighted batting sleeve 90 is in its final configuration and ready for placement on a bat. Note that the distal end of the weighted batting sleeve 90, which is to be positioned over the barrel portion of a bat near a distal end of the bat, is on the left-hand side of FIG. 4I and the narrow proximal end of the weighted batting sleeve 90, which is to be positioned over the taper portion of the bat, is on the right-hand side of FIG. 4I. The axial centerline 78 is representative of the generally tubular construction of the weighted batting sleeve but is also representative of a central axis of a bat when the weighted batting sleeve 90 is slid over the knob and positioned onto the bat. In some options, the weighted batting sleeve 90 may have a total length of between about 10 inches and about 14 inches, and more preferably about 11 inches to about 12 inches.

Figure 5A:
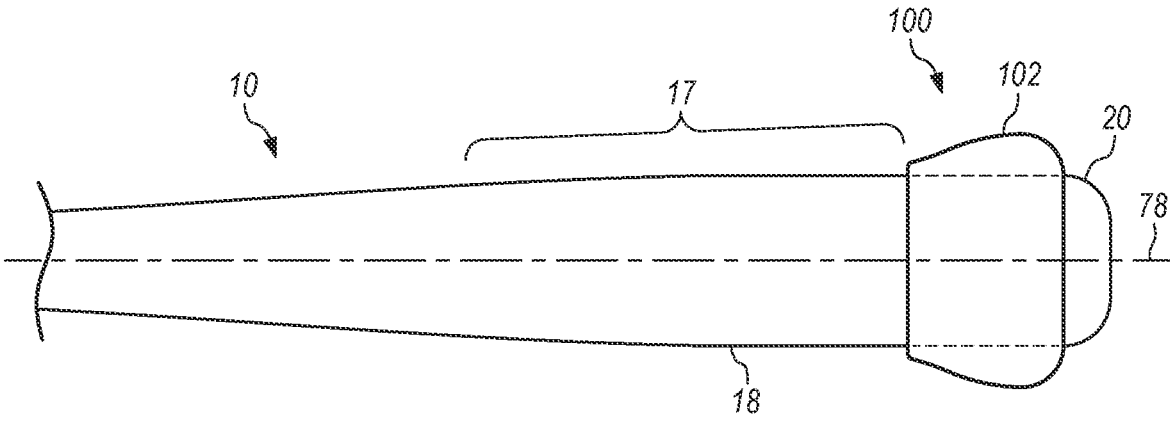
FIGS. 5A-B provide a side view and a cross-sectional side view of a second embodiment of a weighted batting sleeve received on the bat.
Figure 5B:
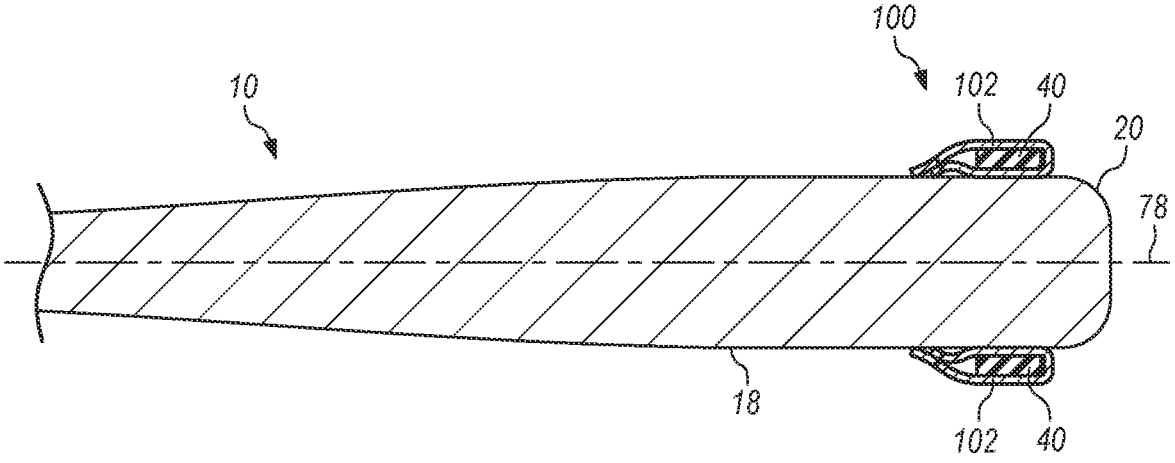

FIGS. 5A-B provide a side view and a cross-sectional side view of a second embodiment of a (shortened) weighted batting sleeve 100 received on the barrel 18 of the bat 10 near the end portion 20. The weighted batting sleeve 100 includes a tubular fabric sleeve 102 that extends a minimal distance in either axial direction (see axis 78) of the elastic ring 40, such that the tubular fabric sleeve 102 primarily covers the elastic ring 40. For example, the tubular fabric sleeve 102 may extend between about 0.5 inches and about 1.5 inches in either axial direction of the elastic ring 40. Accordingly, the tubular fabric sleeve 102 may protect the elastic ring 40 that is positionable adjacent the end portion 20 of the bat 10 without extending into a hitting area 17 of the bat 10. In one option, the tubular fabric sleeve 102 that extends over the elastic ring 40 may have an axial length (distance from left to right as shown in FIGS. 5A-B) from about 2 inches to about 3 inches. Other than the axial length, embodiments with a (short) tubular fabric sleeve 102 may be constructed in the same manner as described herein for longer tubular fabric sleeves. Specifically, while not shown in FIGS. 5A-B, the weighted batting sleeve 100 may be fabricated in a manner substantially consistent with FIGS. 4A-4J, specifically including the formation and construction of the casing 80. In other words, the weighted batting sleeve 100 of FIGS. 5A-B could be identical to the weighted batting sleeve 90 of FIG. 4J except that the sleeve fabric 60 is substantially shorter, optionally even short enough to entirely avoid the hitting area of the bat.

Figure 6A:
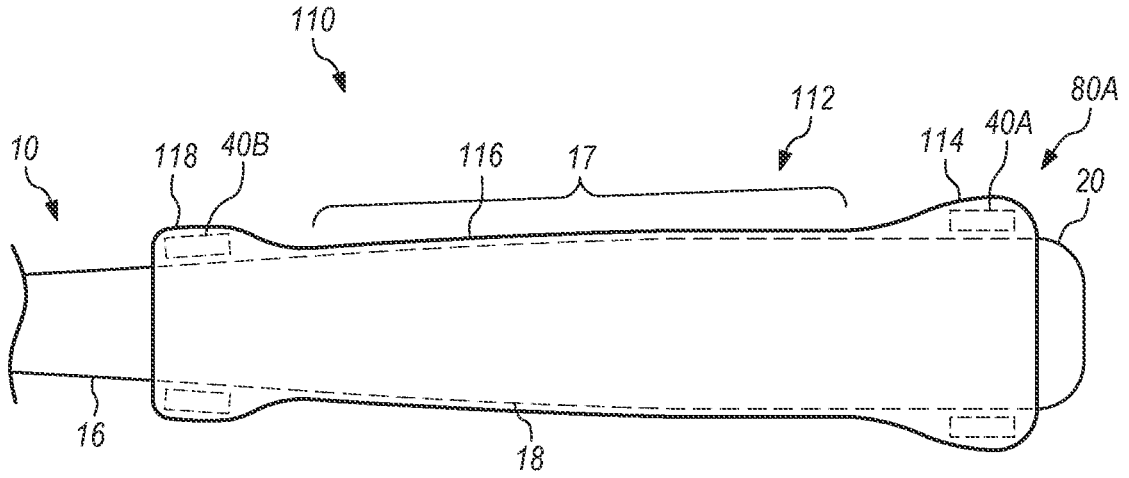
FIGS. 6A-B provide a side view and a cross-sectional side view of a third embodiment of a weighted batting sleeve received on the bat.
Figure 6B:
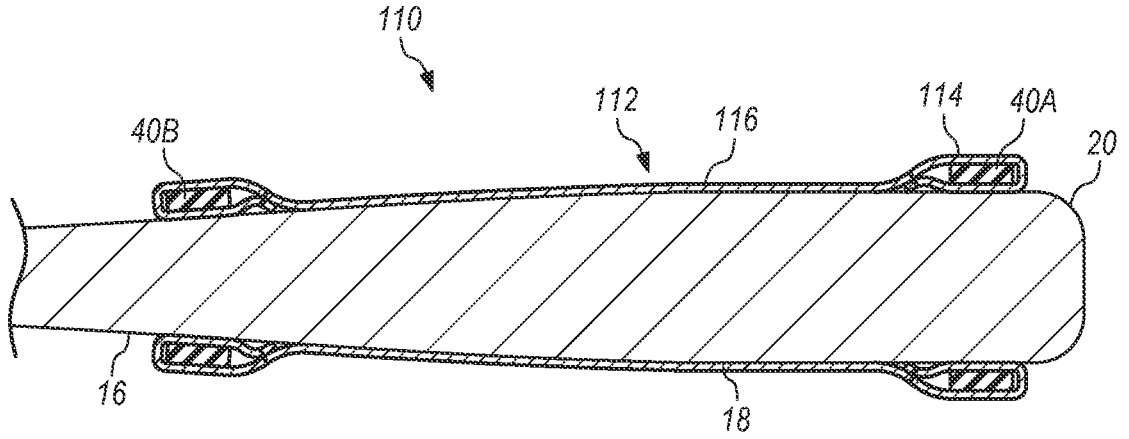

FIGS. 6A-B provide a side view and a cross-sectional side view of a third embodiment of a weighted batting sleeve 100 received on the bat 10. The weighted batting sleeve 100 includes a first elastic ring 40A that is manually stretchable to be received about a barrel portion 18 of a bat 10 and to impart an elastic force against the barrel portion of the bat, and a second elastic ring 40B that is manually stretchable to be received about a taper portion 16 of the bat 10 and to impart an elastic force against the taper portion of the bat. The weighted batting sleeve 100 further includes a tubular fabric sleeve 112 having a first sleeve portion 114 extending over the first elastic ring 40A, a second sleeve portion 116 covering a hitting surface 17 of the bat 10, and a third sleeve portion 118 extending over the second elastic ring 40B. Still further, the weighted batting sleeve 100 includes a first fabric casing 80A enclosing the first elastic ring 40A and secured to the first sleeve portion 114 and a second fabric casing 80B enclosing the second elastic ring 40B and secured to the third sleeve portion 118. The second elastic ring 40B is positionable in the taper portion 16 of the bat 10 with the first elastic ring 40A positioned adjacent the end portion 20 of the bat 10. Accordingly, the two separate elastic rings 40A, 40B may be secured to a bat by a single sleeve 112. The elastic ring 40B near the handle or taper 16 of the bat may have a much smaller circumference, such as 120-140 millimeters, than the circumference of the elastic ring 40A positionable over the barrel 18 of the bat, such as 180-225 millimeters. These embodiments enable a greater amount of weight to be added to the bat without either elastic ring 40A, 40B or other obstruction being positioned in the hitting area 17 of the bat. Optionally, the tubular fabric sleeve 112 may include a second sleeve portion 116 having a circumference that tapers toward the third sleeve portion 118.

It should be recognized that embodiments having first and second elastic rings 40A, 40B and a tubular fabric sleeve 112 having first, second and third sleeve portions 114, 116, 118 may be constructed using the same techniques, materials, and concepts described for any of the embodiments described as having a single elastic ring. Specifically, each elastic ring may be made in the same manner, enclosed in encasing fabric in the same manner, and secured to the tubular fabric sleeve in the same manner, albeit at opposite ends of the tubular sleeve and with dimensions suited to the diameter of the relevant portions of the bat. In some embodiments, the axial length of the tubular fabric sleeve 112 may be slightly longer than the tubular fabric sleeve 60 of FIG. 4J in order to add the third sleeve portion 118, which accommodates a second fabric casing 80B and the second elastic ring 40B. Specifically, while not shown in FIGS. 6A-B, the weighted batting sleeve 110 may be fabricated in a manner substantially consistent with FIGS. 4A-4J, specifically including the formation and construction of two of the casings 80. In other words, the weighted batting sleeve 110 of FIGS. 6A-B could be identical to the weighted batting sleeve 90 of FIG. 4J except that the tubular sleeve fabric 112 is slightly longer to accommodate (cover) the second fabric casing 80B and the second elastic ring 40B in the taper portion of the bat.

Figure 7A:
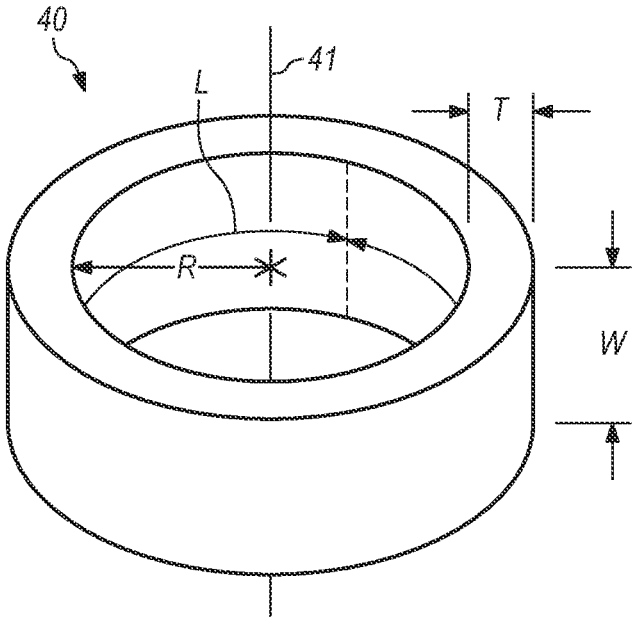
FIG. 7A is a perspective view of an elastic ring illustrating the width, thickness radius of the elastic ring.

FIG. 7A is a perspective view of an elastic ring 40 illustrating the width (W), thickness (T) and radius (R) of the elastic ring. The width (W) of the elastic ring 40 is the distance along the axial direction (see central axis 41) and indicates how far the elastic ring 40 will extend up and down the bat. The thickness (T) of the elastic ring 40 is the distance between the inner surface (directed toward the axis 41) and the outer surface (directed away from the axis 41) and indicates how far the elastic ring 40 will extend out from the bat surface. The radius (R) is the distance from the central axis 41 to each point on the inner surface. For clarity, the radius (R) is ½ of the diameter (D) (not shown). The length (L) of the elastic ring 40 is the distance along the inner surface from a given point (see dashed line) around the inner circumference and back to the given point. The length (L) of the elastic band 40 may also be described as equal to $2\pi R$ (or, the equivalent, $\pi D$). Since $\pi$ is equal to approximately 3.14 and D is the inner diameter, the length of the elastic ring 40 is the mathematical product of 3.14 times the inner diameter (D).

Figure 7B:
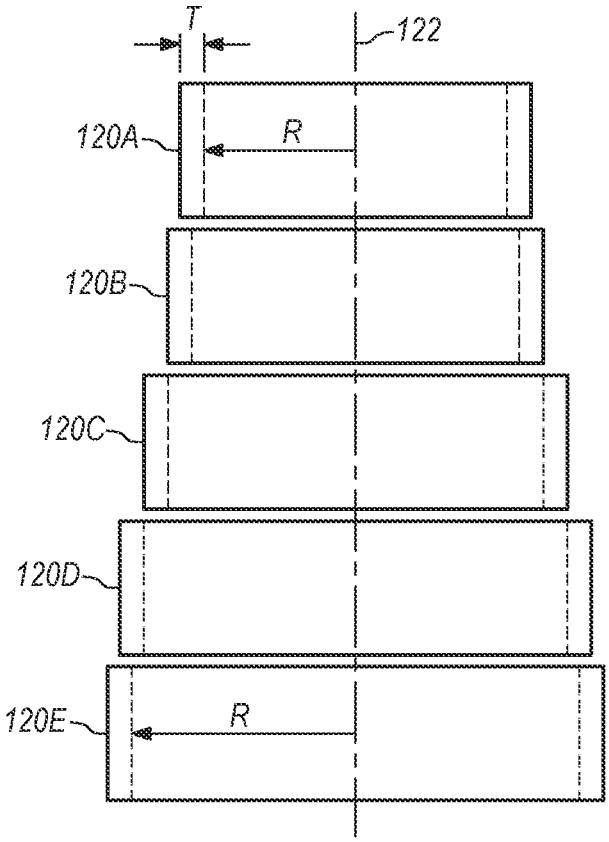
FIG. 7B is a diagram of a plurality of elastic bands of differing size that may be used to form an elastic ring having a desired weight.

FIG. 7B is a diagram of a plurality of elastic bands 120A-E of differing sizes that may be combined to form an elastic ring 40 having a desired weight. The elastic bands 120A-E are illustrated from a side and aligned with a common centerline 122 in order to compare the length (proportional to the radius) and thickness (T) of each elastic band. While five elastic bands are shown, the number of bands may vary to achieve a specific weight and/or a specific thickness (T).

As illustrated, the second elastic band 120B has an inner diameter that is less than the outer diameter of the first elastic band 120A, such that the second elastic band 120B fits "tight" about, and imparts an elastic force on, the first elastic band 120A. For example, the first (inner) elastic band 120A may have a length of 180 mm and a thickness of 2 mm to give an outer surface measuring about 192 mm. However, if the second elastic band 120B has a length of 190 mm, then the second elastic band 120B will be stretched over the first elastic band 120A and apply an elastic (inwardly directed) force on the first elastic band 120A.

Figure 7C:
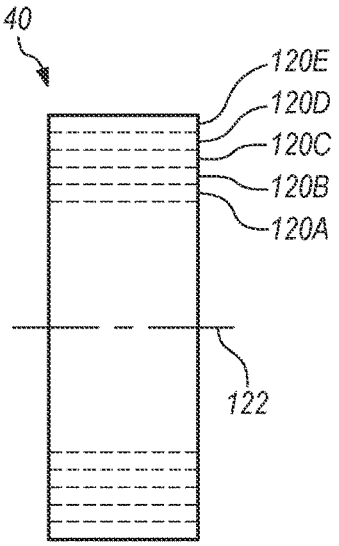
FIGS. 7C-D are a side view and an end view of an elastic ring formed with a plurality of concentric elastic bands.
Figure 7D:
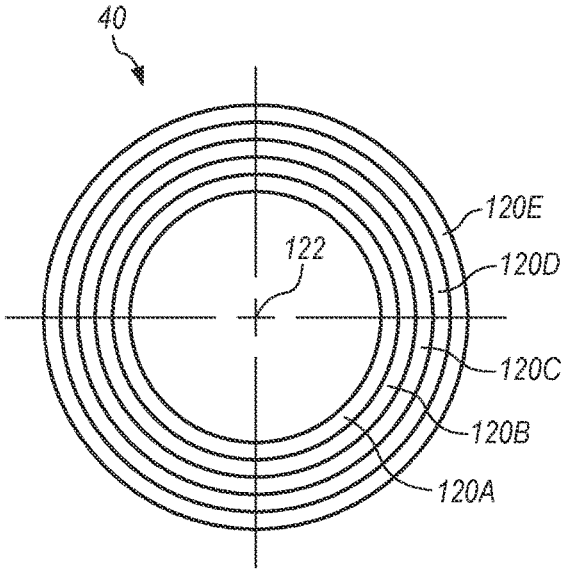

The second, third and fourth elastic bands 120B, 120C, 120D are illustrated as fitting "flush", one over the other without stretching. "Flush" means that the inner circumference of the outer band rests perfectly against the outer circumference of the inner band without any significant forces between the inner and outer bands. The last (outermost) band 120E is a little shorter and tighter against the fourth band 120D and may hold the whole assembly of concentric bands together in a stacked alignment as shown in FIGS. 7C-D. Still, each of the five elastic band may become stretched when positioned onto the barrel of the bat.

FIGS. 7C-D are a side view and an end view of an elastic ring 40 formed with a plurality of concentric elastic bands 120A-E. The elastic ring 40, and each of the individual elastic bands 120A-E, may be described as having a common centerline 122. However, it should be recognized that the elastic ring 40 and individual elastic bands 120A-E are flexible and may form some irregular curvilinear shape when not stretched into position on a bat. The illustration of FIGS. 7C-D are schematic and are not intended to be to scale or in proportion to an actual elastic ring 40.

Figure 7E:
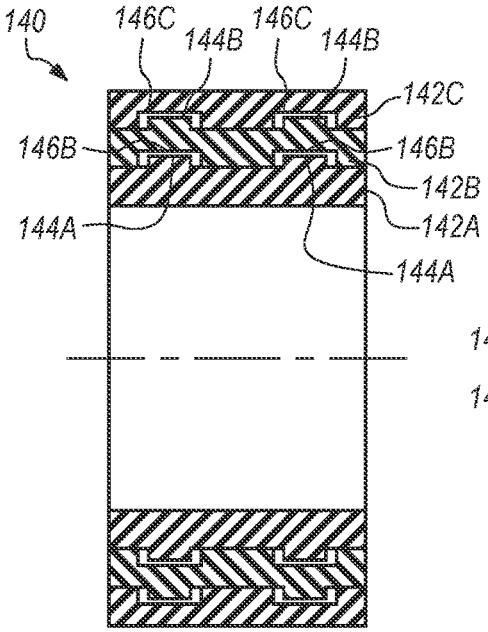
FIGS. 7E-F are a side view and an end view of an elastic ring formed with three concentric elastic bands having interlocking embossed and debossed elements.
Figure 7F:
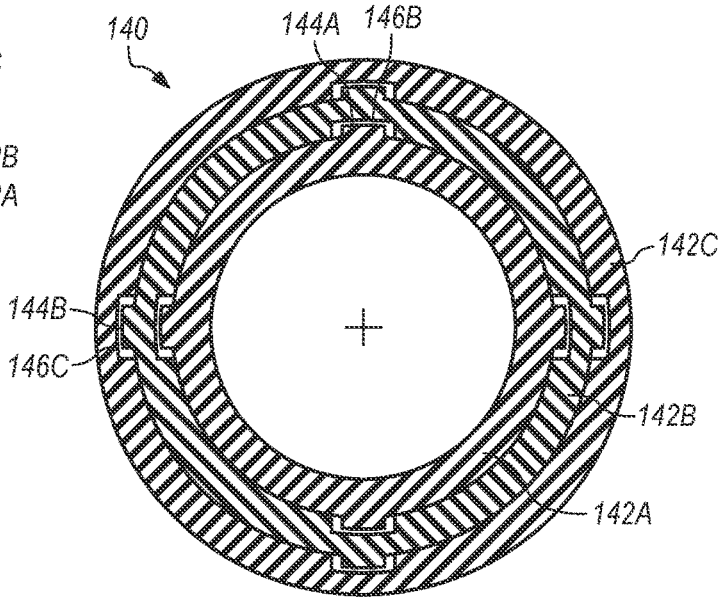

FIGS. 7E-F are a side view and an end view of an elastic ring 140 formed with three concentric elastic bands 142A-C. The elastic ring 140 is similar to the elastic ring 40 of FIGS. 7C-D, except for the number of elastic bands and each of the individual elastic bands 142A-C having embossed elements or protrusions and/or mating debossed elements or recesses. Specifically, the embossed elements 144A on an outer surface of the first elastic band 142A are received within the debossed elements 146B in the inner surface of the second elastic band 142B. Similarly, the embossed elements 144B on an outer surface of the second elastic band 142B are received within the debossed elements 146C in the outer surface of the third elastic band 142C. Since an embossed element cannot slide left or right beyond a debossed element in which it is received without some lifting force, the elastic bands are kept in general stacked alignment as shown. In reference to FIG. 7E alone, the embossed elements could be circumferential ridges and the debossed elements could be circumferential grooves. In reference to the end view of the elastic ring 140 in FIG. 7F, the embossed elements and debossed elements on the adjacent bands are shown to be discrete elements distributed evenly about the circumference of each band.

Figure 8A:
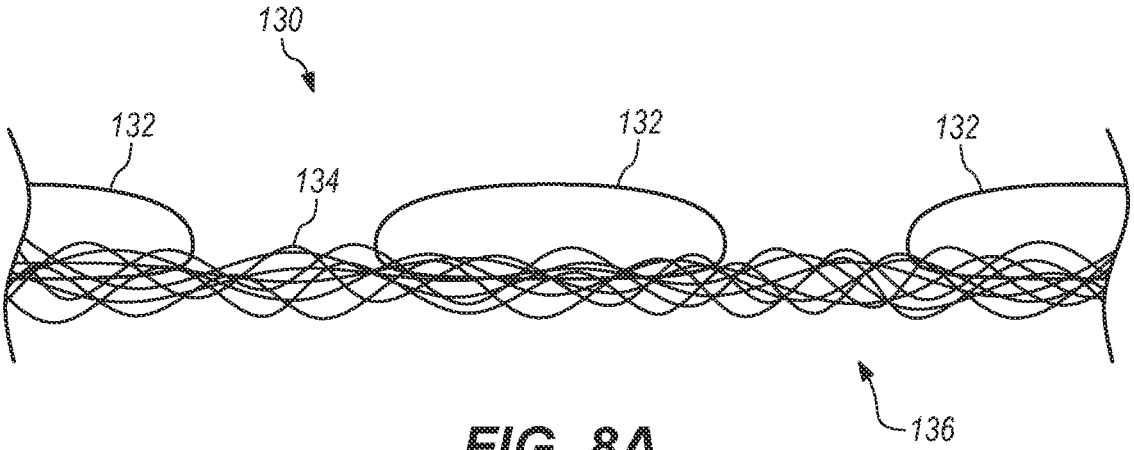
FIGS. 8A-B are schematic diagrams illustrating a plated fabric having plating elements formed on a first side of an elastic fabric.
Figure 8B:
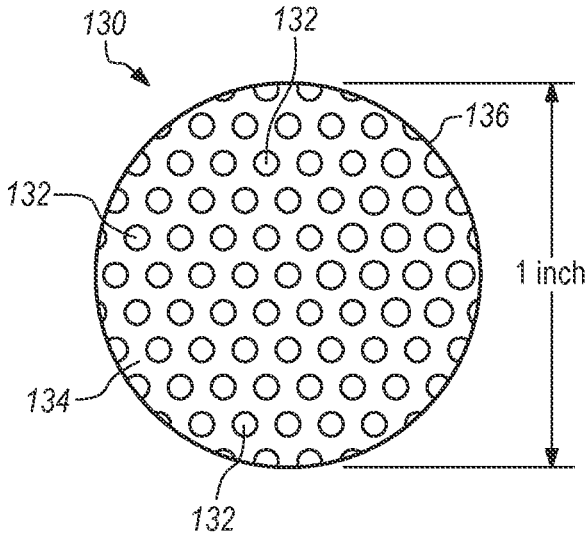

FIGS. 8A-B are schematic diagrams illustrating a plated fabric 130 having plating elements 132 formed on a first side 134 of an elastic fabric 136. FIG. 8A shows that the elastic fabric 136 includes an array, matrix or other configuration of fibers that may be woven or otherwise held together in a continuous layer. The plating elements 132 may be disposed on the first side 134 of the elastic fabric 136 in a liquid form and allowed or caused to flow a short distance into the elastic fabric 136. As a result, the fiber of the fabric 136 that is immediate under the plating elements 132 and nearest the first side 134 may become surrounded by the plating liquid before the plating liquid cures or hardens to form a plate. In one option, the elastic fabric 136 is a stretchable polyester, nylon and/or spandex fabric and the plating elements 132 are an epoxy or other suitable material. Because the epoxy or other material of the plating elements 132 is hard, the portion of fibers held within the plating elements 132 can no longer stretch. The presence of the plating elements 132 will change the stretchability of the elastic fabric 136 and will also provide a high degree of durability to the first surface 134 (or first side) of the plated fabric 130. In one option, the plating elements 132 may extend outward from the surface of the elastic fabric 136 by about 300 microns. In reference to FIG. 8B, an array of plating elements 132 (about 80 shown) are arranged in a hexagonal configuration on the first side 134 of the fabric 136. Accordingly, the plating elements 132 are shown with a diameter of less than about ⅛ inch, although the size and shape of the plating elements 132 may vary. Still, the size of the plating elements 132 on the plated fabric 130 should not be so large as to interfere with the ability of a tubular fabric sleeve made with the plated fabric to fit snug against the surface of a bat, to interfere with feedback received by the batter from the batted ball, or to incur damage from striking the batted ball.

The terminology used herein is for the purpose of describing particular embodiments only and is not intended to limit the scope of the claims. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition, or step being referred to is an optional (not required) feature of the embodiment.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but it is not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

What is claimed is:

1. An apparatus, comprising:

an elastic ring that is manually stretchable to be received about a barrel portion of a bat and to impart an elastic force against the barrel portion of the bat;

a fabric casing enclosing the elastic ring; and a tubular fabric sleeve coupled to the fabric casing and extending over an outer circumferential surface of the elastic ring, wherein the tubular fabric sleeve includes a first sleeve portion forming a distal open end of the tubular fabric sleeve and extending over the outer circumferential surface of the elastic ring and a second sleeve portion forming a proximal open end of the tubular fabric sleeve and extending from the first sleeve portion for covering a hitting area of the bat, wherein the second sleeve portion has an axial length to extend over a hitting area of the bat and into a taper portion of the bat with the first sleeve portion positioned within about one inch of an end portion of the bat, wherein the second sleeve portion is made with a stretchable fabric and has circumferential dimensions that enable the second sleeve portion to stretch over a surface of the bat and fit snug against the surface of the bat, and wherein the second sleeve portion does not include an elastic ring.

2. The apparatus of claim 1, wherein the circumferential dimensions of the second sleeve portion taper toward the proximal open end of the second sleeve portion.

3. The apparatus of claim 2, wherein the elastic ring, fabric casing and tubular fabric sleeve each have a relaxed diameter that is greater than a diameter of a knob portion of the bat.

4. The apparatus of claim 2, wherein the circumferential dimensions of the second sleeve portion taper in proportion to an amount of taper of the taper portion of the bat.

5. The apparatus of claim 1, wherein the elastic forces imparted on the bat by the elastic ring and the tubular fabric sleeve keep the elastic ring in place on the bat during a practice swing and/or a hitting drill using the bat.

6. The apparatus of claim 1, wherein the elastic forces imparted on the bat by the elastic ring and the tubular fabric sleeve keep the elastic ring in place on the bat without fasteners.

7. The apparatus of claim 1, wherein the tubular fabric sleeve is made with a plated fabric having a first plated side that forms an outer surface of the tubular fabric sleeve and a second unplated side that forms an inner surface of the tubular fabric sleeve.

8. The apparatus of claim 7, wherein the plated fabric includes a nylon and spandex blend fabric layer having discrete plates formed on the polyester fabric layer and arranged in a repeating pattern on an outer surface of the polyester fabric layer.

9. The apparatus of claim 7, wherein the fabric casing is formed with a second flexible fabric that is not a plated fabric.

10. The apparatus of claim 1, wherein the elastic ring is made with silicone rubber.

11. The apparatus of claim 10, wherein the elastic ring has a weight between 1 and 4 ounces.

12. The apparatus of claim 1, wherein the elastic ring has a weight that is greater than the weight of the tubular fabric sleeve.

13. The apparatus of claim 1, wherein the elastic ring includes a plurality of concentrically nested elastic bands, wherein each of the concentrically nested elastic bands has a length that is different from the length of the each other concentrically nested elastic bands, wherein the length of the each concentrically nested elastic band increases from an inner-most one of the concentrically nested elastic bands to an outer-most one of the concentrically nested elastic bands, and wherein each of the concentrically nested elastic bands contacts each immediately adjacent one of the concentrically nested elastic bands.

14. The apparatus of claim 13, wherein each of the plurality of concentrically nested elastic bands are made with silicone rubber.

15. The apparatus of claim 14, wherein an adhesive is disposed between adjacent elastic bands.

16. The apparatus of claim 13, wherein each band is about 2 millimeters thick.

17. The apparatus of claim 13, wherein the plurality of concentrically nested elastic bands has at least one pair of directly adjacent elastic bands including a first elastic band having an outer diameter and a second elastic band having an inner diameter, wherein the second elastic band has an inner diameter that is less than the outer diameter of the first elastic band and imparts an elastic force on the first elastic band.

18. The apparatus of claim 1, wherein the tubular fabric sleeve has a thickness between 0.5 millimeters and 1.5 millimeters.

19. The apparatus of claim 1, wherein the elastic ring has a resting diameter that is less than a diameter of the barrel portion of the bat, wherein the elastic ring stretches when slid along the taper portion of the bat and received about the barrel portion of the bat to impart an elastic force against the barrel portion of the bat.

20. The apparatus of claim 1, wherein the second sleeve portion has a resting diameter that is less than a diameter of the barrel portion of the bat, wherein the second sleeve portion stretches when received about the barrel portion of the bat to impart an elastic force against the barrel portion of the bat.

21. The apparatus of claim 1, wherein the second sleeve portion is stretchable to fit a range of bat lengths, a range of bat diameters, and/or a range of bat tapers.

* * * * *